US007603743B2

(12) United States Patent
Kang

(10) Patent No.: US 7,603,743 B2
(45) Date of Patent: Oct. 20, 2009

(54) STRUCTURE FOR CONNECTING A DUST COLLECTING HOSE OF A CENTRAL VACUUM CLEANING SYSTEM

(76) Inventor: Heung-Mook Kang, 63-13, Nonhyeon-dong, Gangnam-gu, Seoul, 135-010 (KR)

( * ) Notice: Subject to any disclaimer, the term of this patent is extended or adjusted under 35 U.S.C. 154(b) by 83 days.

(21) Appl. No.: 10/572,257

(22) PCT Filed: Sep. 18, 2004

(86) PCT No.: PCT/KR2004/002398

§ 371 (c)(1),
(2), (4) Date: Mar. 20, 2007

(87) PCT Pub. No.: WO2005/027704

PCT Pub. Date: Mar. 31, 2005

(65) Prior Publication Data

US 2007/0251046 A1 Nov. 1, 2007

(30) Foreign Application Priority Data

Sep. 19, 2003 (KR) ..... 20-2003-0029742 U

(51) Int. Cl.
*A47L 5/38* (2006.01)

(52) U.S. Cl. ..... 15/314; 15/315; 15/414

(58) Field of Classification Search ..... 15/301, 15/314, 315, 414; *A47L 5/38*
See application file for complete search history.

(56) References Cited

U.S. PATENT DOCUMENTS 5,349,146 A 9/1994 Radabaugh

FOREIGN PATENT DOCUMENTS

| | | |
|---|---|---|
| JP | 5-23267 | 2/1993 |
| JP | 5-23267 A | 2/1993 |
| JP | 5-18447 | 3/1993 |
| JP | 5-18447 U | 3/1993 |
| KR | 161823 | 1/2000 |
| KR | 161823 Y1 | 1/2000 |

*Primary Examiner*—David A Redding
(74) *Attorney, Agent, or Firm*—McDonnell Boehnen Hulbert & Berghoff LLP

(57) ABSTRACT

The present invention discloses a structure for connecting a dust collecting hose of a central vacuum cleaning system, which is capable of connecting a dust collecting hose and a collecting pipe, without opening a closed plate by hand. The structure for connecting a dust collecting hose of a central vacuum cleaning system has a base plate. The base plate comprises a dust collecting pipe and a closed pipe. The dust collecting pipe is connected to a vacuum cleaning system. The closed plate is connected to one end of the dust collecting pipe at its rear end. An installation groove pivotally is formed at the front surface of the closed plate. The closed plate is rotationally installation at the installed in the base plate disposed groove in order to open the dust collecting pipe. A connecting plate is connected to a dust collecting hose at its rear end.

7 Claims, 13 Drawing Sheets

STRUCTURE FOR CONNECTING A DUST COLLECTING HOSE OF A CENTRAL VACUUM CLEANING SYSTEM

TECHNICAL FIELD

The present invention relates to a structure for connecting a dust collecting hose of a central vacuum cleaning system, which is capable of connecting a dust collecting hose to a dust collecting pipe installed on the wall of each room when cleaning, without opening a closed plate by hand.

BACKGROUND ART

Generally, a central vacuum cleaning system is used in large buildings or in apartments, comprising a dust collecting device to collect dust, etc. by the suction force generated by the rotation of a motor; a branch pipe branched into each chamber from the dust collecting device; a dust collecting pipe connected to the front end of each branch pipe and embedded in the wall; and a dust collecting hose connected to the dust collecting pipe.

The structure for connecting a dust collecting hose of a central vacuum cleaning system is briefly explained with reference to FIG. 13. FIG. 13 shows a structure for connecting a dust collecting hose of a central vacuum cleaning system according to the prior technology. As shown, the conventional connecting structure (10) comprises a base plate (20) which is installed on the wall (not shown) of each room of a building; and a connecting pipe (30) of which one end is connected to the base plate (20) and the other end is connected to a dust collecting hose (H).

At the base plate (20), an installation recess (22), wherein the end of a dust collecting pipe (29) projects from the rear, is formed, and a groove (24) is formed at one side of the installation recess (22). A contact point switch (S) is installed on the inner wall of a dust collecting pipe (29). One side of a closed plate (26) is rotatably hinged at the installation recess (22) of the base plate (20), and a handle (28) projects at the other side of the closed plate (26), which is opposite to the hinged portion. The contact point switch (S) comprising+ and − switches of the dust collecting pipe (29) is electrically connected to the central vacuum cleaning system (not shown). A connecting pipe (30) is provided with an inserting part (32) which projects in the length direction of a front end thereof, and a connecting plate C is installed on the outer periphery of the inserting part (32), which contacts the contact point switch S of the dust collecting pipe (29) to control the turn-on/off of the central vacuum cleaning system.

In order to use a conventional structure for connecting a dust collecting hose of the central vacuum cleaning system as mentioned above, the user grips a handle (28) of the closed plate (26) with one hand. Then, the user turns the closed plate (26) on the center of the hinged portion and opens the dust collecting pipe (29). With the other hand, the user grips the connecting pipe (30) connected to a dust collecting hose (H) and inserts it into the open end of the dust collecting pipe (29). Then, the connecting plate (C) of the connecting pipe (30) pushes the + and − switches of the dust collecting pipe (29) and the contact point switch (S), respectively. At this time, the user can turn on/off the central vacuum cleaning system by operating the switch, which is installed on the handle (not shown) at the end of the dust collecting hose (H).

As a consequence, the central vacuum cleaning system turns on. However, this operation is difficult since the user inserts the connecting pipe (30) into the dust collecting pipe (29) as he grips and pivots the closed plate (26) with one hand.

Therefore, there is a need for a constitution, wherein the connecting pipe (30) connected with the dust collecting hose (H) can be easily inserted into the dust collecting pipe (29) without opening the closed plate (26) with hands of the user.

DISCLOSURE OF INVENTION

Therefore, the present invention is to solve the above problems by providing a structure for connecting a dust collecting hose of a central vacuum cleaning system, which can easily install a connecting plate of a dust collecting hose at a dust collecting pipe.

In order to achieve the object, the present invention relates to a structure for connecting a dust collecting hose of a central vacuum cleaning system comprising:

A base plate wherein a dust collecting pipe communicating with the central vacuum cleaning system and one end of the dust collecting pipe are connected backward; an installation recess communicating with the dust collecting pipe is installed at the front surface; and a closed plate for opening and closing the dust collecting pipe is installed at the installed recess to be rotatably opened and closed;

A connecting plate in which a dust collecting hose is connected to the rear side thereof, and which is inserted into the dust collecting pipe to be electrically connected thereto; and An opening/closing member which is installed at the connecting plate to pivotally open and close the closed plate of the outlet member.

A push part projects at one side of the closed plate of the base plate; a supplementary push part extends at the end of the push part to be bent; a groove of a corresponding shape of the push part is formed at one side of the installation recess of the base plate; an entrance hole is perforated through the bottom of the groove; the connecting plate extends in the length direction; a guide protrusion having a horizontal guide hole at one side of the outer periphery of the extended portion projects outwardly; the opening/closing member is inserted into the guide hole of the connecting plate so as to be slid back and forth, and the closed plate is opened and closed as the front end of the opening/closing member is slid through the entrance hole.

A supplementary installation recess is formed from the upper part of the installation recess at the base plate; a plurality of guide protrusions are extendedly formed in a lengthwise direction at both circumferential surfaces of the connecting plate; a stop plate is formed on the boundary with the inserting part; the front of the switch member is open and empty inside; and a guide rail is formed so that the guide protrusion of the connecting plate is inserted to be slid in the inner sidewall.

As above, a structure for connecting a dust collecting hose of a central vacuum cleaning system wherein a dust collecting pipe is communicated with the vacuum cleaning system and one end of the dust collecting pipe is connected to the rear side; and an installation recess is communicated with the dust collecting pipe on the surface of the front side; characterized in that the installation recess comprising a base plate where a closed plate switching the dust collecting pipe is installed to be rotated and switched. A dust collecting hose is connected at the rear of the connecting plate, and is inserted into another dust collecting hose, being electrically connected. A switch member is installed at the connecting plate, which rotationally switches the closed plate of an outlet member. By the above constitution, the connecting structure of the present invention has a working effect of largely improving the cleaning process by inserting a push lever of a feed pipe installed in the front end of a connecting plate into an installation recess of a base plate and a support installation recess so that a closed plate is automatically opened.

The purpose and advantage of the device is going to be more clarified by the detailed description of the following embodiments referring to the enclosed drawings.

DETAILED DESCRIPTION

Figure 1:
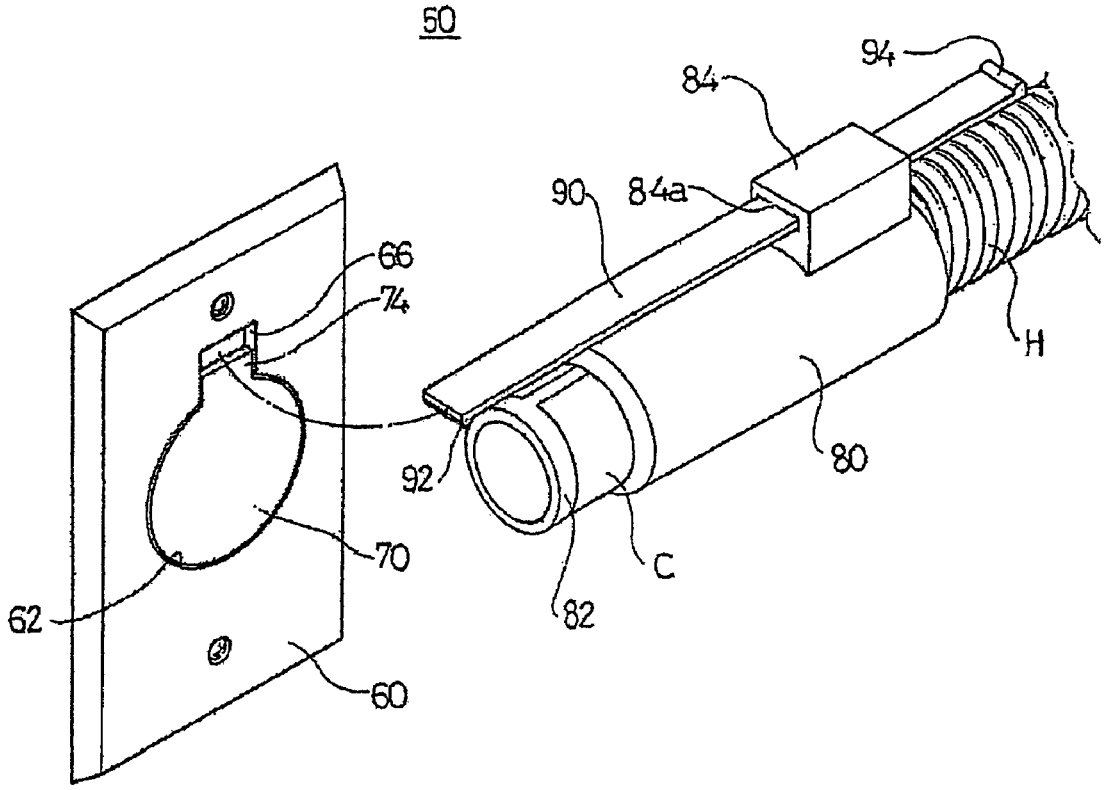
FIG. 1 is a disassembled perspective view of connecting a dust collecting hose of a central vacuum cleaning system according to the preferred embodiments of the present invention.
Figure 2:
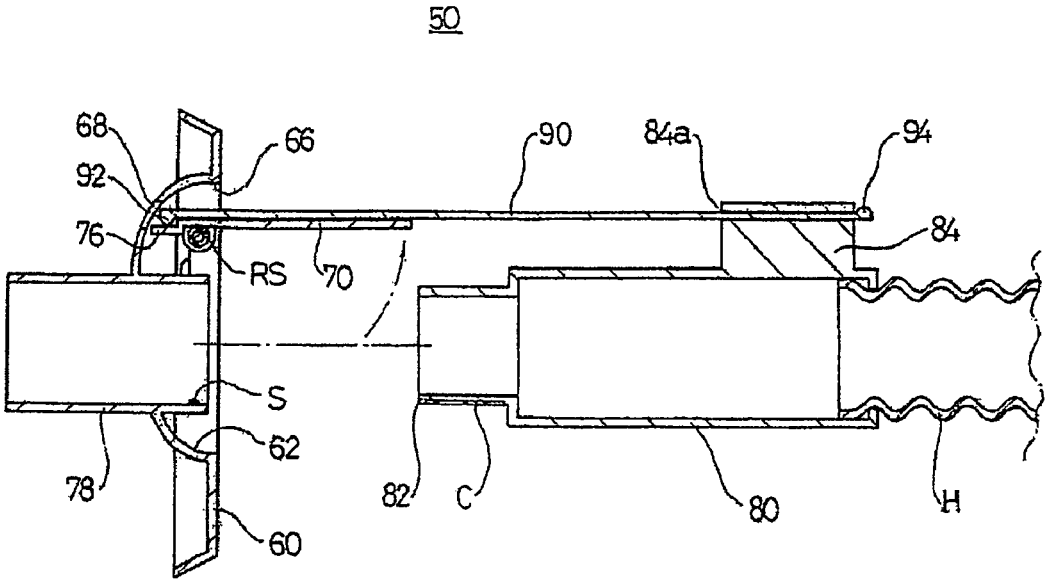
FIG. 2 is a sectional view, which shows an open condition of a closed plate by a push lever.
Figure 3:
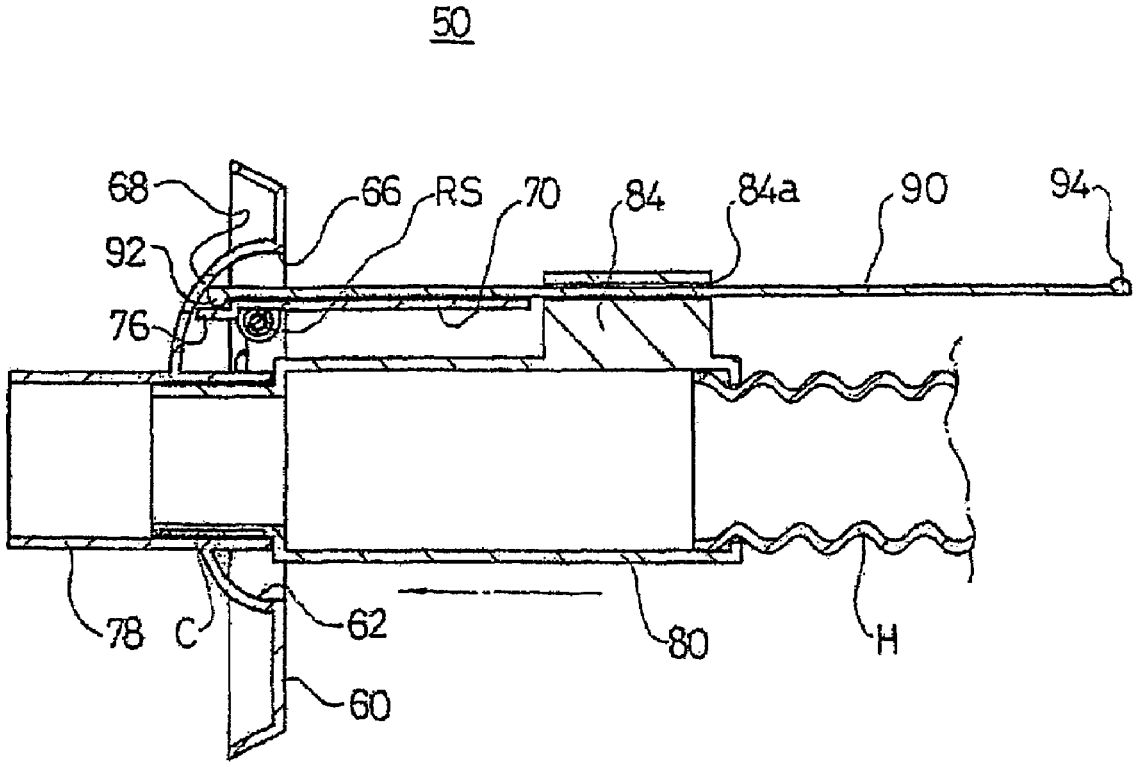
FIG. 3 is a sectional view, which shows a condition of inserting a connecting plate of a dust collecting hose into an exhaust pipe.

FIG. 1 shows a disassembled condition of a structure (50) for connecting a dust collecting hose of a central vacuum cleaning system according to the preferred embodiments of the present invention. FIG. 2 shows a condition wherein a closed plate (70) is rotated approximately 90 degrees by pushing a push lever (90) of FIG. 1. FIG. 3 shows a condition wherein a connecting pipe (80) which is connected to the dust collecting hose (H) in FIG. 2 is inserted into a dust collecting pipe (78).

Referring to FIGS. 1, 2 and 3, the connecting structure (50) of the present invention has a base plate (60) wherein an installation recess (62) is formed on the overall surface. In the installation recess (62) of a base plate (60), the front end of a dust collecting pipe (78) connected to the central vacuum cleaning system (not shown) is combined from the rear, and a part of it is exposed to the surface of the installation recess (62). A contact point switch (S) is installed at the caliber of the dust collecting pipe (78). The contact point switch (S) is electrically connected to the central vacuum cleaning system (not shown). A groove (66) is made on the periphery of the installation recess (62) of the base plate (60). An entrance hole (68) is perforated through the bottom of the groove (66). The base plate (60) is installed on the wall (not shown) of a building, or etc.

A closed plate (70) is extended to the outside from the exterior of one side. At the free end of a push part (74), a support push part (76) is extendedly bent downward. A closed plate (70) is installed at the installation recess (62) of the base plate (60). There is a hinge combination at the bottom of the support push part (76) of the closed plate (70) and the groove (66) of the base plate (60). A return spring (RS) is installed at the combined part of the hinge, so the rotated closed plate (70) can be restored into its original condition.

The inserting part (82) of a connecting pipe (80) is projected at the front end. The inserting part (82) is made smaller than the diameter of a connecting pipe (80). A connecting plate (C) is attached to the circumferential surface of the inserting part (82). The connecting plate (C) is made of a material which electricity can be conducted through. An electric wire (not shown) is laid through the inside of a dust collecting hose (H) and a connecting pipe (80) in the connecting plate (C), being electrically connected. A connecting plate (C) is connected with a contact point switch (S) of a dust collecting pipe (78), controlling the operation of the central vacuum cleaning system.

The inserting part (82) of the connecting pipe (80) is inserted into the end of the dust collecting pipe (78) which is projected towards the installation recess (62) of the base plate (60). A dust collecting hose (H) is combined at the rear end of the connecting pipe (80). A guide protrusion (84) where a guide hole (84*a*) is perforated, is outwardly projected at the upper part of the outer surface of the connecting pipe (80). A push lever (90) is inserted into a guide hole (84*a*) of a guide protrusion (84). Ideally, a push lever (90) is made in a flat stick shape. At one end of a push lever (90), a push protrusion (92) is projected at the bottom. At the other end, a protrusion (94) for preventing a separation is projected at the top surface.

The working effects of a structure for connecting a dust collecting hose of a central vacuum cleaning system according to the preferred embodiments of the present invention with the above constitution are explained referring to the enclosed drawings.

Referring to FIG. 2, the user completely pushes a push lever (90) towards the front. Then, a push lever (90) is slid at the guide hole (84*a*) of the guide protrusion (84) of a connecting pipe (80), and the sliding is stopped when the protrusion (94) for preventing a separation contacts the part of a guide protrusion (84). In this condition, the user pushes the upper part of a push lever (90) with his thumb, and makes the push lever (90) not move by gripbing a connecting pipe (80) with his four other fingers. Subsequently, the user inserts the front end of a push lever (90) projected forwardly into the entrance hole (68) of a base plate (60). Then, the support push part (76) of a closed plate (70), which is located at a part of the entrance hole (68), is pushed backward by the front end of a push lever. Accordingly, a closed plate (70) is pivoted centering the hinge combined part, towards the bottom of a push lever (90). At this time, the closed plate (70) is completely rotated in a right angle from the surface of the base plate (60) by the push protrusion (92) of the push lever (90).

Referring to FIG. 3 again, when the pivot of a closed plate (70) is completed, the user moves a connecting pipe (80) towards a dust collecting pipe (78) while leaving the push lever (90) being blocked. At this time, the rear end of a push lever (90) is more projected to the rear of the guide protrusion (84) of a connecting pipe (80). If the connecting pipe (80) moves towards the dust collecting pipe (78), the inserting part (82) of a connecting pipe (80) is completely inserted into the dust collecting pipe (78). At this time, the connecting plate (C) of an inserting part (82) pushes the contact point switch (S) of a dust collecting pipe (78), and operates the central vacuum cleaning system (not shown) by controlling the handle switch (not shown) installed at the end of a dust collecting hose (H).

Afterwards, when the cleaning is completed, the user pulls out the inserting part (82) of the connecting pipe (80) from the dust collecting pipe (78) in a reverse sequence, and then, pulls out the push lever (90) from the entrance hole (68) of the base plate (60). As a consequence, the closed plate (70) closes the open end of the dust collecting pipe (78) due to a restoration power of a return spring (RS).

Figure 4:
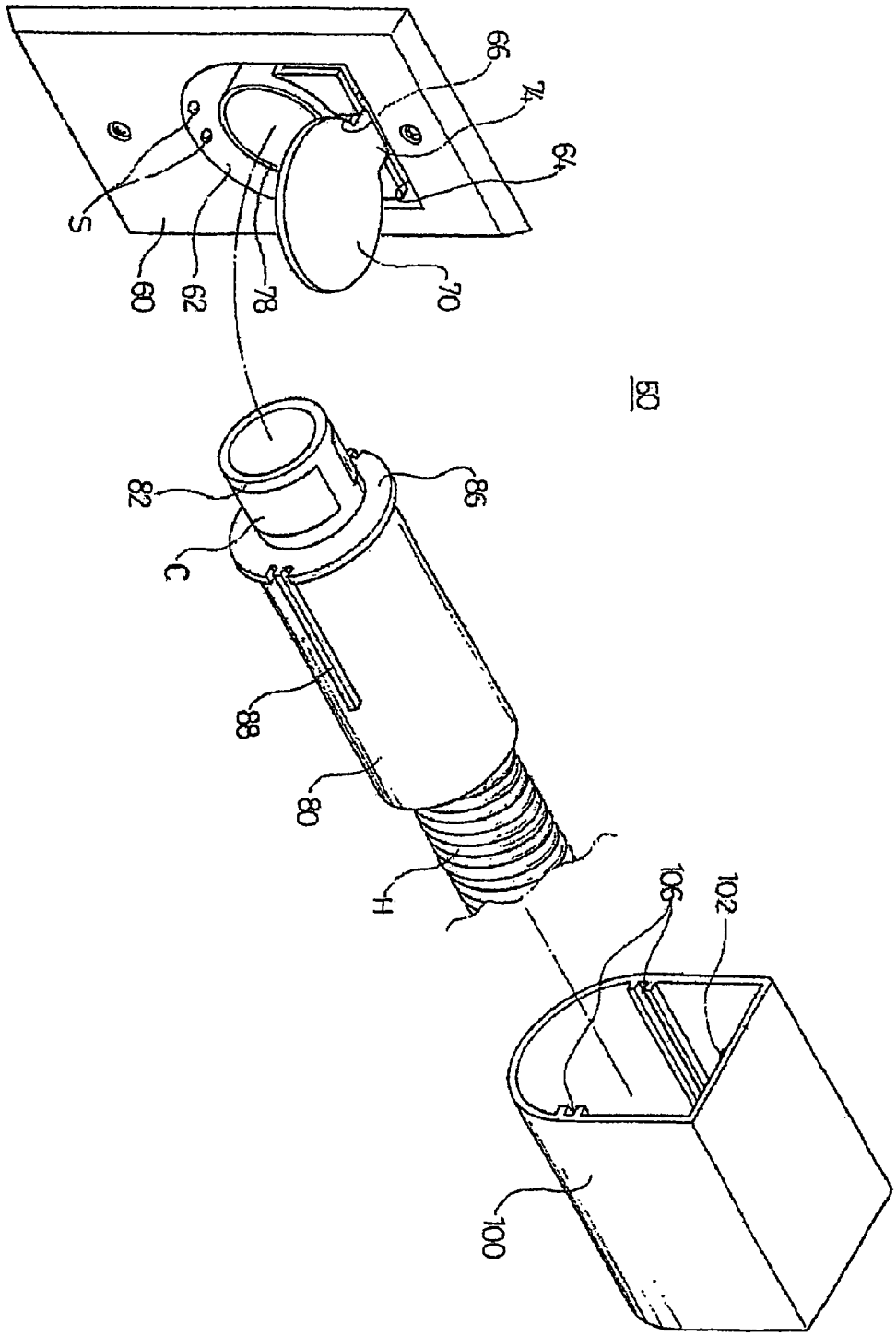
FIG. 4 is a disassembled perspective view of a structure for connecting a dust collecting hose of a central vacuum cleaning system according to other embodiments of the present invention.
Figure 5:
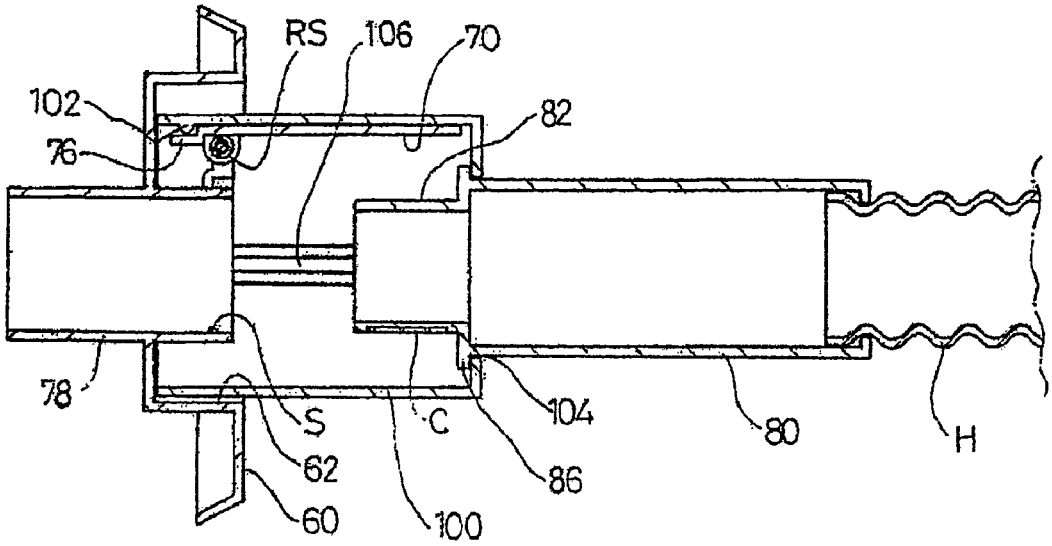
FIG. 5 is a sectional view, which shows an open state of the closed plate in FIG. 4.

FIG. 4 illustrates a disassembled condition of a structure (50) for connecting a dust collecting hose of a central vacuum cleaning system according to other embodiments of the present invention. FIG. 5 shows an open condition of a closed plate (70) of FIG. 4, and FIG. 6 shows that a connecting pipe (80) is combined with the dust collecting pipe (78) of FIG. 4.

Figure 6:
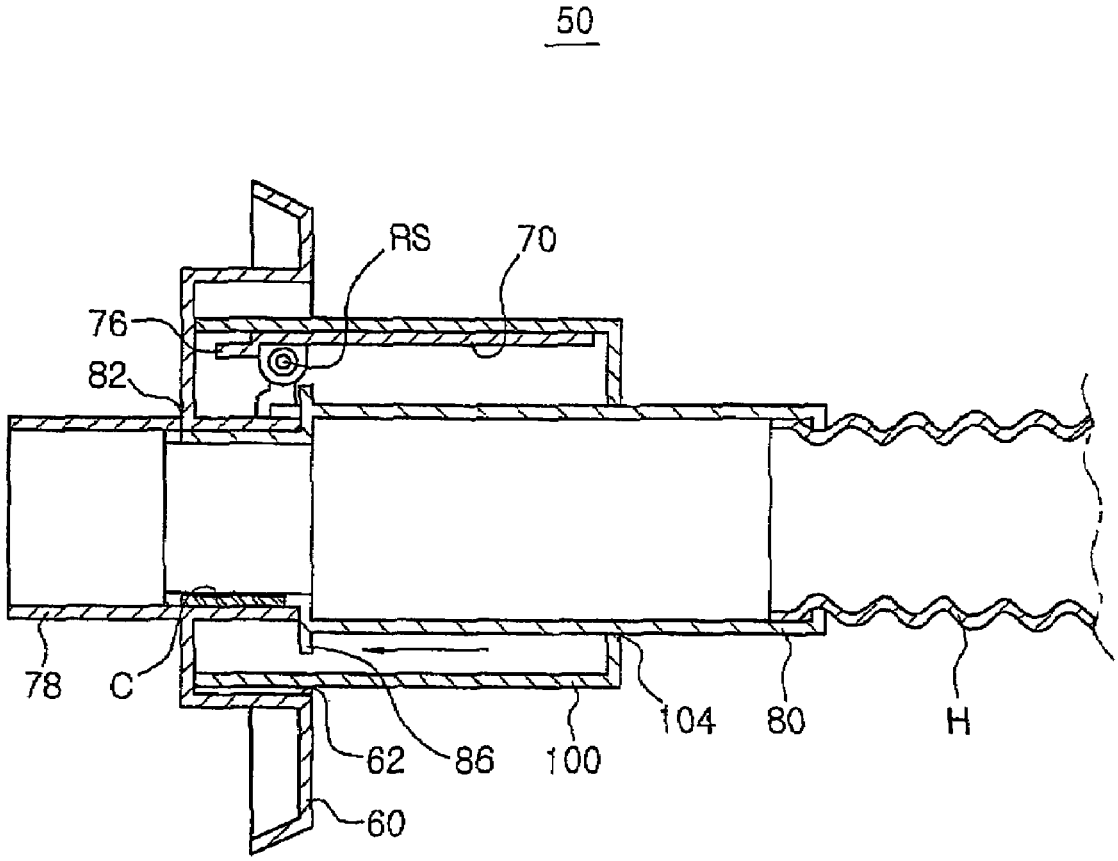
FIG. 6 is a sectional view, which shows a state when a connecting plate is slid and connected to the exhaust pipe.

As shown in FIGS. 4, 5 and 6, a support installation groove (64) is made at the base plate (60) as it is extended from the upper part of the installation groove (62). A support installation groove (64) is formed around the periphery of the push protrusion (92) of a closed plate (70). The overall shape of the combination of the installation groove (62) and the support installation groove (64) is "U" wherein the upper part is closed. A plurality of contact switches (S) are installed on the lower inner surface of the installation groove (62).

A stop flange (86) is projected towards the outside on the boundary with an inserting part (82) on the circumferential wall of a connecting pipe (80). Also, a plurality of guide protrusions (88) are protracted in a length direction from the stop flange (86) on the circumferential surface of a connecting pipe (80). The guide protrusions (88) are formed on both sides of the connecting pipe (80).

A feed pipe (100) is installed on the circumferential surface of a connecting pipe (80). A feed pipe (100) is made corresponding to an installation groove (62) and a support installation groove (64). A feed pipe (100) is empty with an open front. At least one guide protrusion is projected downward at the ceiling of the feed pipe (100). A sliding hole (104) of the connecting pipe (80), which is an exteriorly located, is created on the inner wall of the closed rear of a feed pipe (100). A guide protrusion (102) is to increase the installing function by making the feed pipe (100) not contact the surface when inserted into the installation groove (62).

The working effect of the structure for connecting a dust collecting hose of a central vacuum cleaning system is explained according to other embodiments of the present invention, referring to the enclosed drawings.

Referring to FIG. 5 again, the user firstly inserts a feed pipe (100) into the circumferential surface of a connecting pipe (80). At this time, a guide protrusion (88) of a connecting pipe (80) is inserted into each guide rail (106) of the feed pipe (100) and slid. At the same time, a sliding hole (104) of a feed pipe (100) contacts the circumferential surface of a connecting pipe (80). The feed pipe (100) inserted into the connecting pipe (80) is pushed until the closed rear inner wall contacts a stop flange (86). Then, the user inserts an installation groove (62) of a base plate (60) and a support installation groove (64) into the open end of a feed pipe (100). As a consequence, the support push part (76) of a closed plate (70), which is projected from inside the support installation groove (64), is pressed, retreated, and pivoted centering the combined part by hinge. That is to say, the closed plate (70), which used to be in a condition of contacting the end of a dust collecting pipe (78), gets separated, and remains as being rotated within approximately 90 degrees.

Referring to FIG. 5 again, the user inserts a feed pipe (100) into the circumferential surface of a connecting pipe (80). At this time, the guide protrusion (88) of a connecting pipe (80) is inserted into each guide rail (106) of a feed pipe (100), becoming a sliding guide. At the same time, the sliding hole (104) of a feed pipe (100) contacts the circumferential surface of a connecting pipe (80). The feed pipe (100) inserted into the connecting pipe (80) is pushed until the inner wall of the closed rear contacts a stop flange (86). Then, the user inserts the open end of a feed pipe (100) into the installation groove (62) of a base plate (60) and the support installation groove (64). As a consequence, the support push part (76) of a closed plate (70), which is projected from inside the support installation groove (64), is pressed, retreated, and pivoted centering the combined part by a hinge. That is to say, the closed plate (70), which used to be in a condition of contacting the end of a dust collecting pipe (78), gets separated, and remains as being rotated within approximately 90 degrees.

Referring to FIG. 6 again, the user pushes a connecting pipe (80) to the dust collecting pipe (78) direction. Then, the inserting part (82) of a connecting pipe (80) is inserted into the open end of a collecting dust pipe (78). At this time, the guide protrusion (88) of a connecting pipe (80) is forwardly slid according to the guide rail (106) of a feed pipe (100), at the same time, a connecting pipe (80) moves forward being inserted into the sliding hole (104) of a feed pipe (100).

Figure 7:
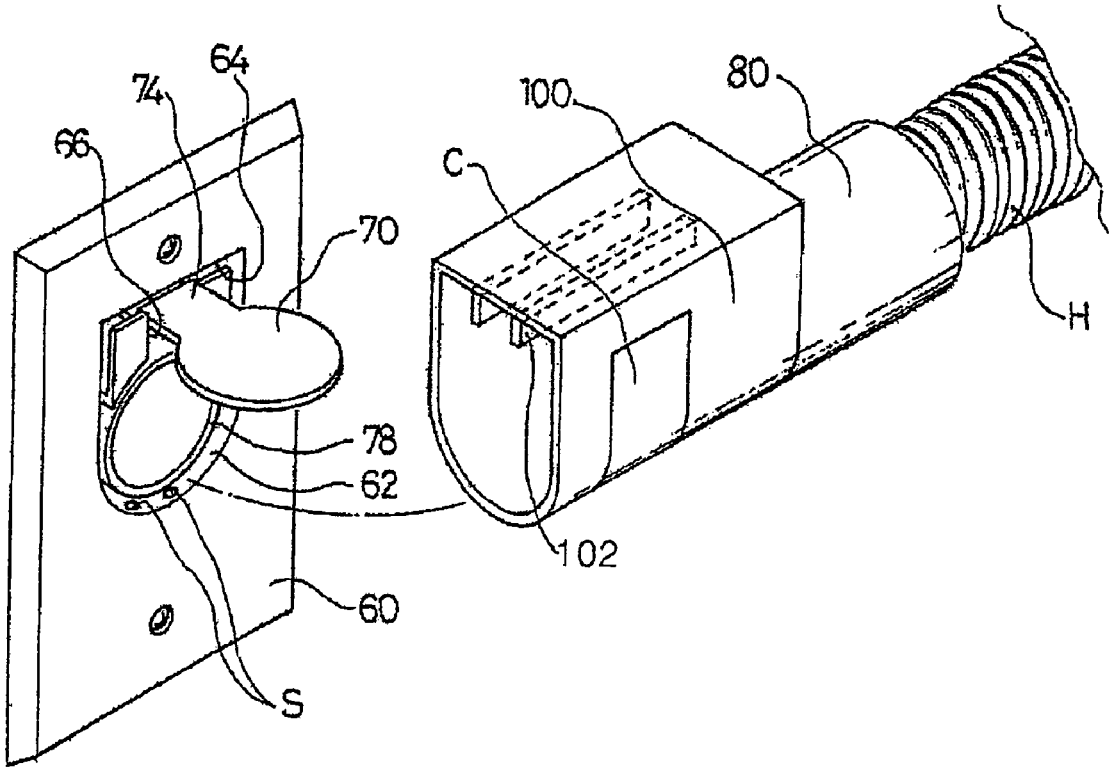
FIG. 7 is a disassembled perspective view, which shows a modified example of FIG. 4.
Figure 8:
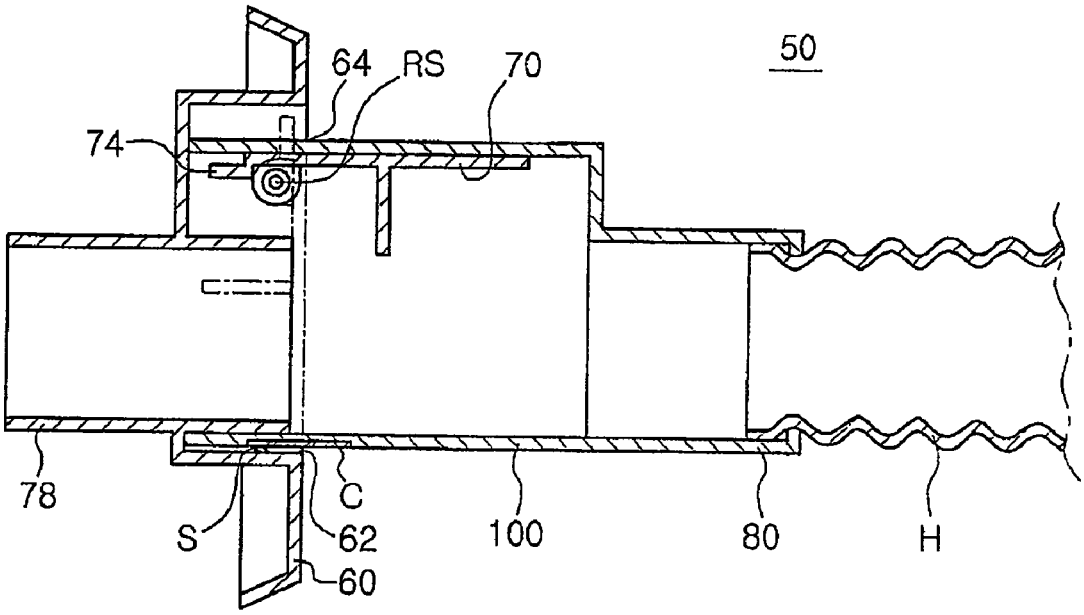
FIG. 8 is a sectional view of FIG. 7 assembled together.

FIG. 7 is a modified example of a base plate (20) and a feed pipe (100) as shown from FIG. 4. FIG. 8 shows a connecting plate (80) from FIG. 7, being combined with a base plate (60).

Referring to FIGS. 7 and 8, a connecting pipe (80) having a dust collecting hose (H) is fixed on the wall of the closed rear of a feed pipe (100). A plurality of connecting plates (C) are installed at both circumferential surfaces of a feed pipe (100). This is to electrically connect the connecting plate (C) of a feed pipe (100) to the contact point switch (S) of a base plate (60) when the feed pipe (100) is inserted into the installation groove (62) of abase plate (60) and the support installation groove (64).

By the above constitution, if a feed pipe (100) is inserted into the installation groove (62) and the support installation groove (64) of a base plate (60), a closed plate (70) pivots with centering a hinge combined part of a push (74) by the feed pipe (100), opening a dust collecting pipe (78). Therefore, the feed pipe (100) becomes a connecting path of air or other impurities as it communicates with the dust collecting pipe (78). At this time, each connecting plate (C) of a feed pipe (100) is electrically connected to the contact point switch (S) installed at the installation groove (62) of a base plate (60). By installing a blocking film (79) on the bottom of the closed plate (70), it can prevent impurities from flowing backward into the space made between a push part (74) and a base plate (60).

Figure 9:
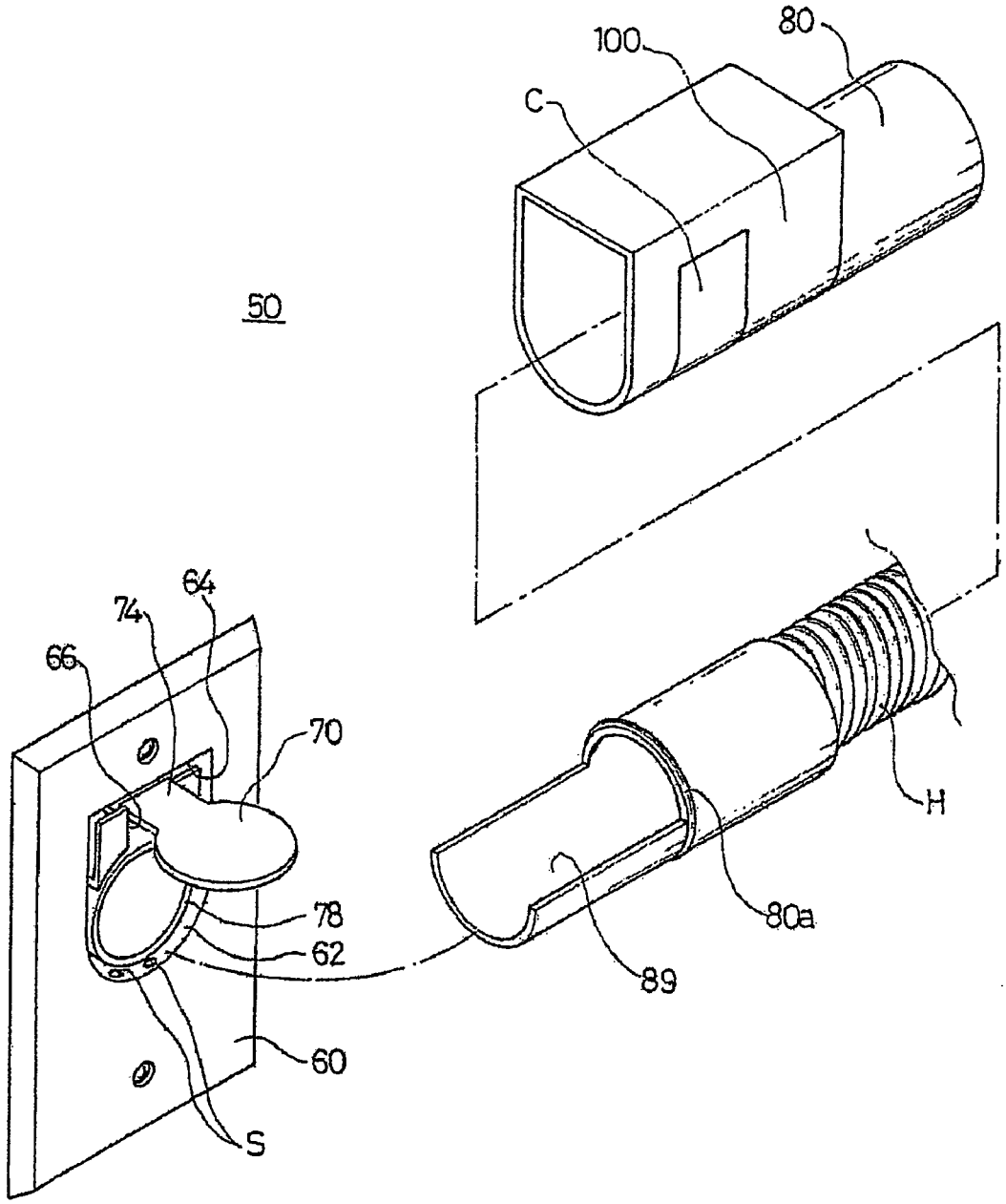
FIG. 9 is a disassembled perspective view, which shows another modified example of FIG. 4.
Figure 10:
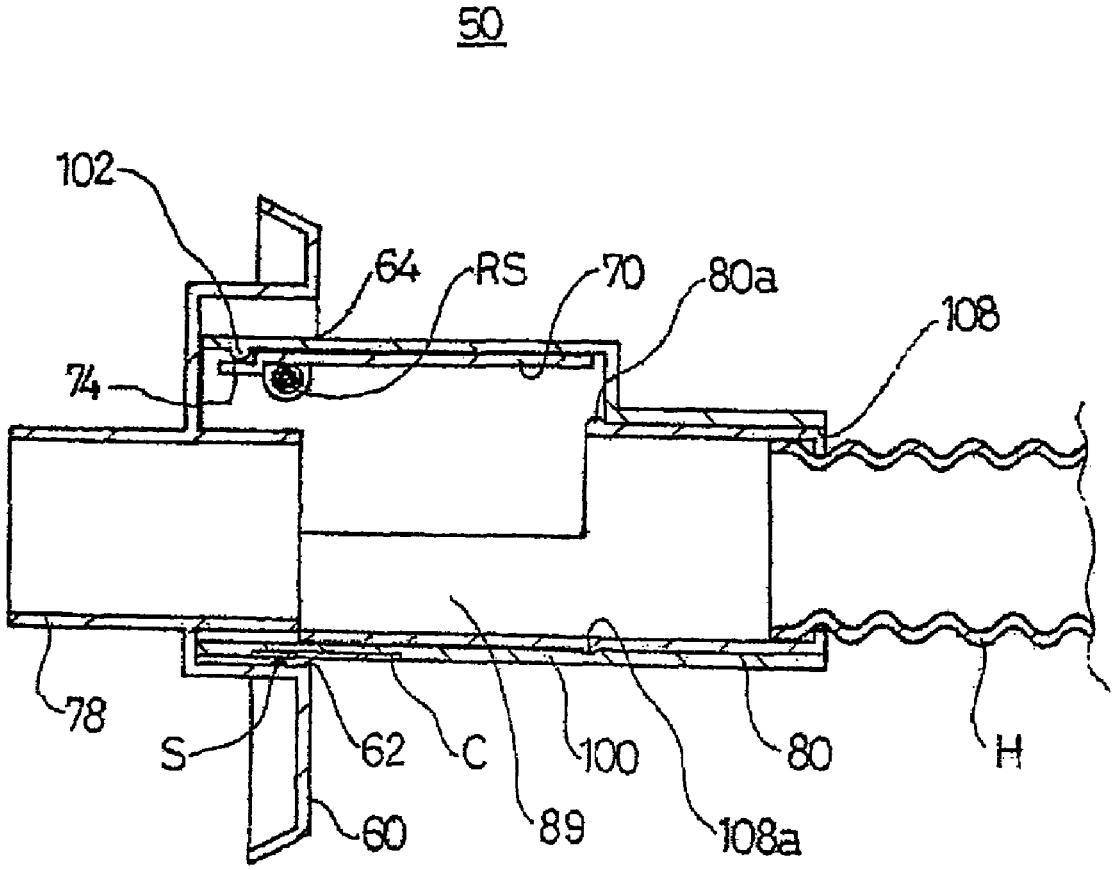
FIG. 10 is a sectional view of a combined state of FIG. 7, which shows a condition when a blocking hole is located on the lower part.
Figure 11:
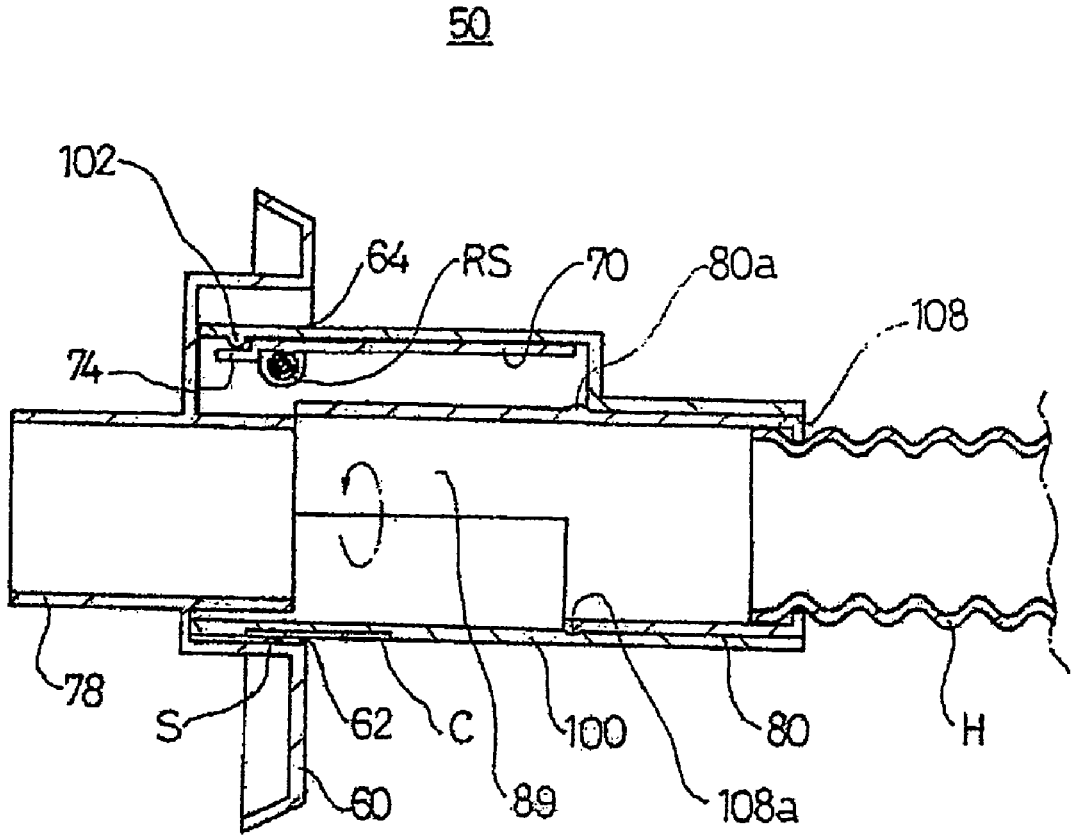
FIG. 11 is a sectional view of a combined state of FIG. 7, which shows a condition when the blocking hole is located on the upper part.

FIG. 9 illustrates another example of a feed pipe (100) of FIG. 4. FIGS. 10 and 11 show that the connecting pipe (80) of FIG. 7 is combined with the base plate (60) of FIG. 7.

As shown in FIGS. 9, 10 and 11, an assembly hole (108) is perforated through the closed rear wall of a feed pipe (100). In the inner wall of a feed pipe (100), a ring-shaped assembly groove (108*a*) is made. At the front end of a connecting pipe (80), a rotational protrusion (80*a*) corresponding to the assembly groove (108*a*) of the feed pipe (100) is projected. Also, at the front end of a feed pipe (100), a blocking part (89) is projected as it is extended from the rotation protrusion (80*a*) in a length direction. At both circumferential surfaces of a feed pipe (100), a plurality of connecting plates (C) are installed. Hence, when a pipe (100) is inserted into the installation groove (62) and a support installation groove (64) of a base plate (60), the connecting plate (C) of the feed pipe (100) is electrically connected to the contact point switch (S) of the base plate (60).

By the above constitution, if a feed pipe (100) is inserted into the installation groove (62) and the support installation groove (64) of a base plate (60), a closed plate (70) is rotated, opening a dust collecting pipe (78). At the same time, a blocking part (89) of a connecting pipe (80) contacts the lower part of the open end of the dust collecting pipe (78). Next, the user manually rotates the connecting pipe (80) in clockwise and counterclockwise directions. Accordingly, the blocking part (89) of a connecting pipe (80) contacts the upper part of the open end of a dust collecting pipe (78).

Figure 12:
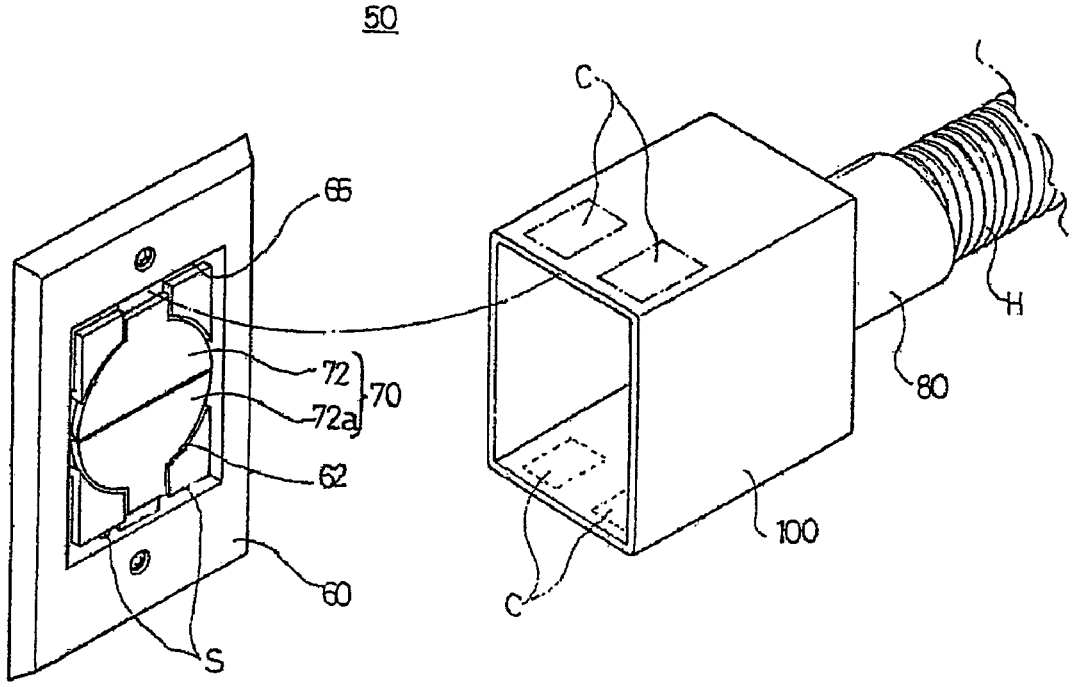
FIG. 12 is a disassembled perspective view, which shows another modified example of FIG. 4.
Figure 13:
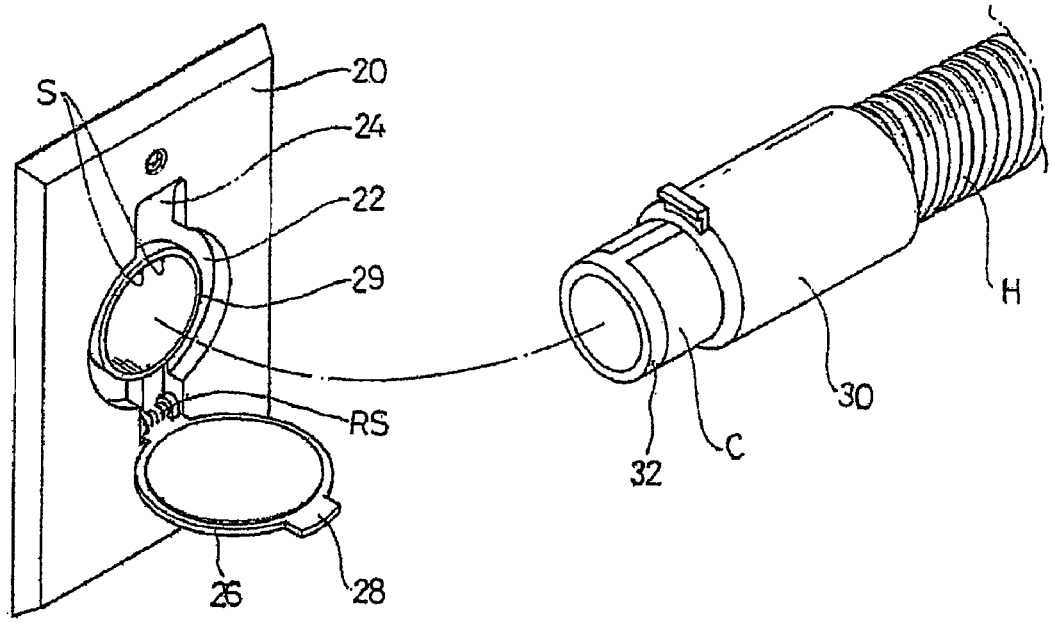
FIG. 13 is a sectional view, which shows a structure for connecting a dust collecting hose of a central vacuum cleaning system according to the prior technology.

FIG. 12 illustrates another modified example of a closed plate (70) and a feed pipe (100) of FIG. 4. As shown in FIG. 13, a support installation groove (65) is formed from the installation groove (62) till the upper and lower parts of the base plate (60). Ideally, a support installation groove (65) is usually rectangular, but it can also be circular, or etc. A closed plate (70) includes the upper closed plate (72) and the lower closed plate (72*a*). These closed plates (72) (72*a*) are combined to a base plate (60), respectively, with a hinge. It is ideal to make a feed pipe (100) in a square shape corresponding to the support installation groove (65).

When the user inserts a feed pipe (100) into the support installation groove (65) of a base plate (60), the upper closed plate (72) and the lower closed plate (72*a*) are pivoted upwards and downwards, respectively, opening the dust collecting pipe (78).

INDUSTRIAL APPLICABILITY

As mentioned above, a structure for connecting a dust collecting hose of a central vacuum cleaning system according to the embodiments of the present invention has a working effect of largely improving the cleaning process only if a push lever or a feed pipe at the connecting plate is inserted into an installation groove or a support installation groove so that a closed plate is automatically open, instead of separately opening the closed plate installed at the base plate.

Although the present invention is specifically explained with the above embodiments, the present invention is not limited thereof as stated above. Therefore, a person skilled in the art can modify the invention within an ordinary knowledge to which the present invention pertains.

The invention claimed is:

1. A structure for connecting a dust collecting hose of a central vacuum cleaning system comprising:

a dust collecting pipe which is communicated with the vacuum cleaning system;

a base plate wherein one end of the dust collecting pipe is connected to the rear side of the base plate, and an installation recess is formed on the front surface of the base plate to be communicated with the dust collecting pipe, and a closed plate is mounted rotatively on the installation recess to open and close the dust collecting pipe;

a connecting pipe which is connected to the dust collecting hose at the rear side of the connecting pipe and is inserted into the dust collecting pipe and electrically connected; and a switching member installed in the connecting pipe so that when the connecting pipe is being inserted into the collecting pipe the switching member protrudes towards the closed plate and extends beyond the open end of the connecting pipe, said switching member contacting the closed plate before the connecting pipe connects to the dust collecting pipe to rotate and switch the closed plate.

2. The structure for connecting a dust collecting hose of a central vacuum cleaning system as in claim 1, wherein a push part is projected at one side of the closed plate of the base plate, a support push part is extendedly bent at the end of the push part, a groove corresponding to the push part is formed at one side of the installation recess of the base plate, and an entrance hole is perforated through the bottom of the groove;

wherein the connecting pipe is extended in a lengthwise direction and a guide protrusion is projected outwardly having a horizontal guide hole at one side of the extended circumferential surface of the connecting pipe;

wherein the switching member is a push lever which is inserted into the guide hole of the connecting pipe and is installed to be slid in the front and in the rear of the guide protrusion, and the front end of the push lever switches the closed plate as being slid through the entrance hole.

3. The structure for connecting a dust collecting hose of a central vacuum cleaning system as in claim 2, wherein a push protrusion is projected to the lower direction in the bottom surface of the front end of the push lever so that the closed plate can be completely opened wide.

4. The structure for connecting a dust collecting hose of a central vacuum cleaning system as in claim 1, wherein the support installation recess is formed from the upper part of the installation recess at the base plate, a plurality of guide protrusions are extendedly formed in a lengthwise direction at both circumferential surfaces of the connecting pipe and a stop flange is formed on the boundary with the inserting part of the connecting pipe which is inserted into the dust collecting pipe, characterized in that the switching member is a feed pipe wherein the front of the feed pipe is opened and emptied inside, and a guide rail is formed respectively so that the guide protrusion of the connecting pipe is inserted to be slid in the inner sidewall of the feed pipe.

5. The structure for connecting a dust collecting hose of a central vacuum cleaning system as in claim 1, wherein a support installation recess is formed from the upper part of the installation recess at the base plate, a rotating protrusion is projected at the front end of the connecting pipe and a blocking part is extended from the rotating protrusion in a lengthwise direction, wherein the switching member is characterized in that an assembly hole, in which the connecting pipe is inserted and pivoted, is perforated through the wall of the closed rear of the switch member, and a ring shaped assembly groove is formed in which the rotating protrusion is inserted and guided at the inner wall of the switching member.

6. The structure for connecting a dust collecting hose of a central vacuum cleaning system as in claim 1, wherein the structure comprises a plurality of closed plates.

7. The structure for connecting a dust collecting hose of a central vacuum cleaning system as in claim 5, wherein the closed plates are plural.

* * * * *

UNITED STATES PATENT AND TRADEMARK OFFICE

CERTIFICATE OF CORRECTION

PATENT NO. : 7,603,743 B2
APPLICATION NO. : 10/572257
DATED : October 20, 2009
INVENTOR(S) : Heung-Mook Kang It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 297 days.

Signed and Sealed this

Fifth Day of October, 2010

David J. Kappos

David J. Kappos
*Director of the United States Patent and Trademark Office*